United States Patent [19]

De Phillipo et al.

[11] Patent Number: 4,760,379

[45] Date of Patent: Jul. 26, 1988

[54] FAIL-SAFE HIGH TEMPERATURE ALARM

[75] Inventors: Edward J. De Phillipo, Aston, Pa.; Larry Mortimer, Willingboro, N.J.

[73] Assignee: Bell of Pennsylvania, Conshohocken, Pa.

[21] Appl. No.: 904,845

[22] Filed: Sep. 5, 1986

[51] Int. Cl.[4] ..... G08B 29/00

[52] U.S. Cl. ..... 340/507; 340/501; 340/509; 340/588; 340/664; 379/378; 374/100; 374/111; 236/91 F; 236/91 G; 165/11.1

[58] Field of Search ..... 340/501, 500, 507, 588, 340/589, 517, 662, 509, 663, 664; 379/378; 374/100, 111; 236/91 F, 91 G; 165/11.1

[56] References Cited

U.S. PATENT DOCUMENTS

| | | | |
|---|---|---|---|
| 2,367,509 | 1/1945 | Knowlton | 340/662 |
| 2,645,765 | 7/1953 | Bixby | 340/662 |
| 2,691,158 | 10/1954 | Wittenberg | 340/662 |
| 3,159,825 | 12/1964 | Bianchi et al. | 340/661 |
| 3,889,069 | 6/1975 | Ault | 379/378 |
| 4,240,077 | 12/1980 | Hughes | 340/501 |
| 4,285,023 | 8/1981 | Kalivas | 340/662 |

*Primary Examiner*—Donniel L. Crosland
*Attorney, Agent, or Firm*—Lowe, Price, LeBlanc, Becker & Shur

[57] ABSTRACT

A temperature sensor located at a region being monitored controls an output switch that in one position when ambient temperature is below a predetermined temperature applies current to only a first loop circuit and in another position when ambient temperature is at or above the predetermined temperature applies current to only a second loop circuit. Currents in the first and second loop circuits are measured by ferrods to determine whether an over-temperature condition at the region monitored has taken place. An alarm circuit connected to outputs of the ferrods generates an alarm signal in response to a negative transaction of current in the first loop circuit or a positive transition of current in the second loop circuit. A failure in either loop circuit accordingly is insufficient to disable the system. A solid state timer periodically opens the second loop circuit to repeat the alarm signal when the second loop circuit is closed until corrective action is taken.

18 Claims, 2 Drawing Sheets

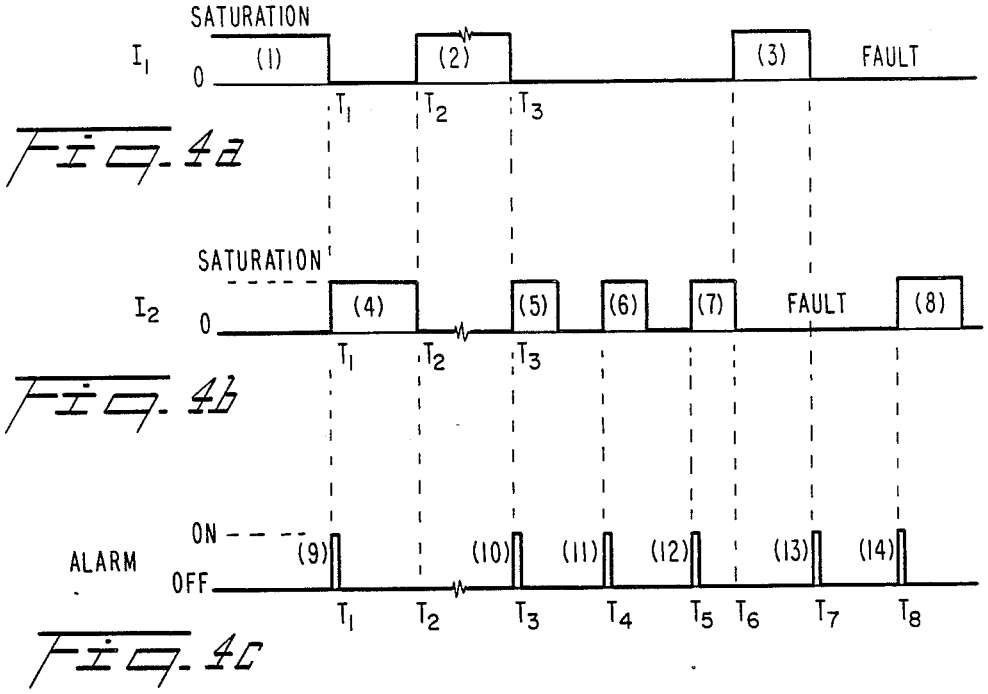
Fig. 4a
Fig. 4b
Fig. 4c
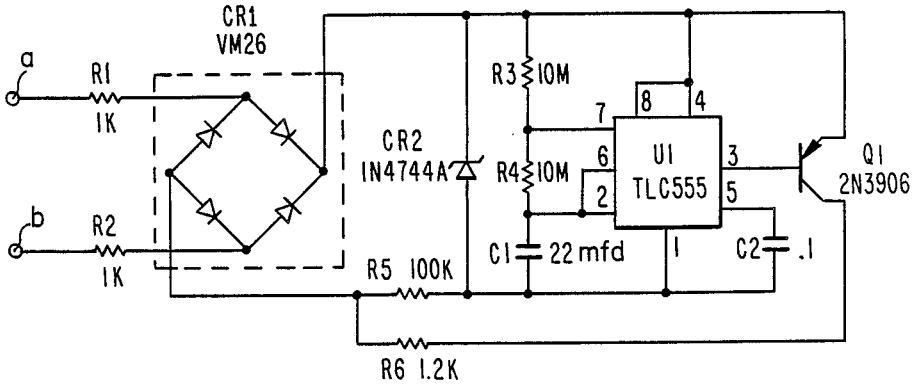
Fig. 3

FAIL-SAFE HIGH TEMPERATURE ALARM

TECHNICAL FIELD

This invention relates generally to alarm systems and methods and more particularly toward fail-safe alarms operative to generate periodic alarm messages in response to over-temperature conditions in regions monitored.

BACKGROUND ART

To protect facilities such as a telephone switching office or computer installation from fire or from failure as a result of over-temperature conditions, temperature sensors generally are installed at the facilities to generate alarm signals in response to excessive temperatures. The alarm signals are transmitted to a remote control center which may contain an electronic switching system (ESS) wherein telephone office personnel monitor cathode ray tube displays to determine temperature and other conditions at each facility. In response to excessive temperature at a particular facility, the cathode ray tube is controlled by software to indicate the existence of the condition, its location and how to take corrective action.

Prior art alarm systems of this type of which we are aware have two inherent deficiencies. First, the system itself is prone to failure as a result of a failure of a temperature sensor at the facility monitored or a failure in the link for transmitting an alarm signal from the facility to the control center. Second, the display at the control center develops a single alarm message on the cathode ray tube in response to an over-temperature condition. The message, however, may be overlooked or ignored by attending personnel and the alarm accordingly unheeded. A need therefore exists to provide fail-safe monitoring of temperature and transmission of temperature alarm data to a control center and to periodically repeat over-temperature alarm signals until responsive action is taken.

DISCLOSURE OF INVENTION

One object of the invention is to provide a method of and system for detecting out of range parameters using complementary detection circuits to improve system reliability.

Another object of the invention is to provide a high temperature alarm system that has improved reliability using complementary high temperature alarm circuitry.

Another object is to provide an alarm system and method wherein in response to an out of range condition, alarm messages at a remote location are repeated until responsive action is taken.

Another object is to provide an over-temperature alarm system for measuring ambient temperature at a remote facility and in response to excessive temperature transmitting an alarm signal to a control center for display, wherein the system is insensitive to certain component failures and further wherein the alarm signal repeats periodically until corrective action is taken.

These and other objects are carried out in accordance with the invention by measuring ambient temperature in the region being monitored, and when the ambient temperature is less than a predetermined temperature, generating current in only one of first and second circuits; otherwise generating current only in the other one of the circuits. Current in the first and second circuits is measured, and an alarm signal is generated when an absence of current in the first circuit or a presence of current in the second circuit is detected. Accordingly, a failure in either one of the two circuits does not disable the alarm system.

In accordance with another aspect of the invention, the second circuit is periodically interrupted to successively generate alarm signals during an over-temperature condition. The successive alarm signals are converted into appropriate alarm messages at the control center.

A system in accordance with the invention comprises an external parameter sensor at a region being monitored, and first and second current detectors. A first circuit contains, in series, the external parameter sensing means, a current source and the first current detector. A second, complementary circuit, contains the sensing means, the current source and the second current detector. Switch means responsive to the parameter sensing means closes alternatively the first and second circuits to cause current from the current source to flow in one circuit or the other. An alarm means, responsive to outputs of the first and second current detectors, generates an alarm signal when an absence of current in said first circuit or a presence of current in the second circuit is detected. Preferably, the alarm means is enabled by a negative transistion of current in the first circuit or a positive transition of current in the second circuit.

In accordance with a preferred embodiment, the external parameter sensor comprises a temperature sensor, and the current detectors comprise ferrods which saturate in response to circuit current. The second circuit preferably comprises telephone lines over which the signals from the thermostat are transmitted to the ferrods at the control center. The temperature sensor may advantageously comprise a thermostat containing the switch means for controlling current flow in the first and second circuits to saturate one or the other of the ferrods.

In accordance with a further aspect of the invention, an interrupter connected in the second circuit periodically opens the second circuit to interrupt flow of current therethrough when the circuit is otherwise closed by the switch means. An alarm signal is generated each time there is a positive transition of current flow in the second circuit to cause an alarm message at the control center to repeat successively until corrective action is taken.

The interrupter preferably is a solid state timer circuit operative to periodically open the second circuit, which preferably is provided by telephone lines. The timer is energized by current in the telephone lines thereby requiring no external power source. The timer circuit is configured to consume a maximum current that is less than that which would significantly load the lines.

Another object of the invention is therefore to provide in the system described an interrupter formed of a solid state timer which is powered from the circuit being interrupted.

A further object is to provide a solid state timer in such a system wherein the circuit being interrupted as well as powering the timer comprises telephone lines.

Still other objects and advantages of the present invention will become readily apparent to those skilled in this art from the following detailed description, wherein only the preferred embodiment of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

FIG. 3 is a detailed circuit diagram of the interrupter provided in FIG. 2.

FIGS. 4(*a*)–4(*c*) are waveforms explaining the operation of the invention.

BEST MODE FOR CARRYING OUT THE INVENTION

Figure 1:
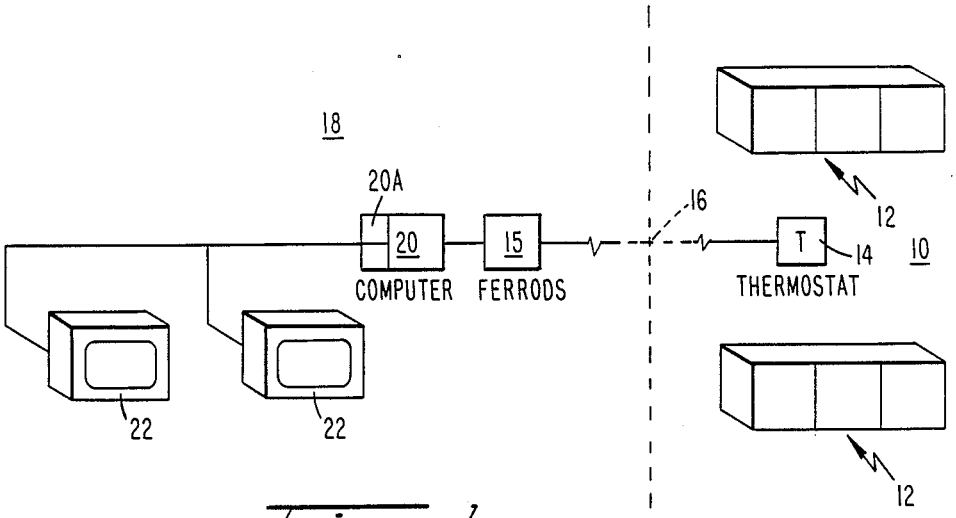
FIG. 1 is an illustration of an over-temperature alarm system to which the principles of this invention are applied.

Referring to FIG. 1, a telephone switching office or other facility to be protected, designated generally as 10, contains switching equipment or computers 12, or other equipment, to be monitored by a thermostat 14 which measures ambient temperature within a particular region of the facility. The output of the thermostat 14, which may be signal processed by driver circuitry (not shown) transmits a signal indicating whether ambient temperature is within a predetermined range over telephone lines 16 to a control center 18, remote from the facility monitored. A detector 15 at center 18, which may be a telephone company office housing an electronic switching system (ESS), receives the signal on lines 16. A computer 20 at the ESS responds to the output of the detector 15 to generate via character generator 20A appropriate alarm messages, such as "temperature exceeds 85 degrees F. in facility 10" on the screens of cathode ray tubes 22 to be monitored by attending telephone company personnel.

Although only a single facility 10 being monitored is shown in FIG. 1, it is to be understood that numerous different facilities in practice would be monitored by different thermostats 14, and that temperature dependent data among the facilities will be transmitted to control center 18 along individual telephone lines, such as 16, or conventionally multiplexed on a single set of telephone lines. Further, although the system monitored in the preferred embodiment described herein comprises telephone company switching and facility monitoring equipment, the principles of this invention are not so limited.

In accordance with the invention, acquisition and transmission of temperature dependent data from each monitored facility, such as 10, to control center 18 are made fail-safe by providing temperature reporting using a pair of complementary temperature detection and transmission circuits whereby a failure in either will not disable the alarm system. Furthermore in accordance with the invention, as shall be described in detail hereinafter, in the event of an over-temperature condition at the facility monitored, alarm messages are periodically displayed at cathode ray tubes 22, until the over-temperature condition is removed or other corrective action is taken.

Figure 2:
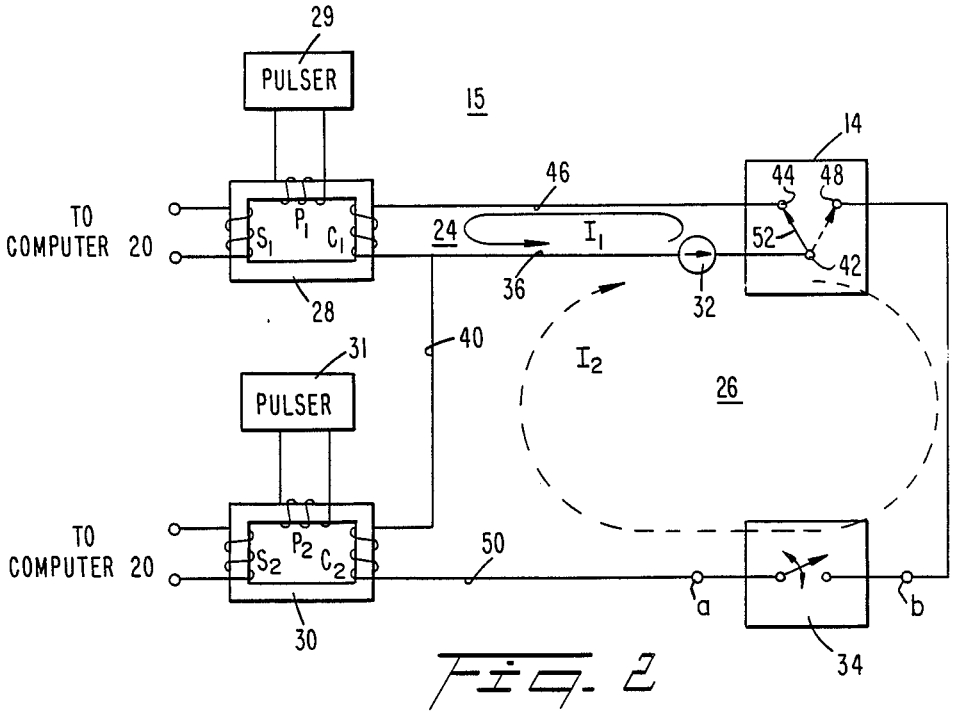
FIG. 2 is a simplified circuit diagram of a system implemented in accordance with the invention.

Referring to FIG. 2, thermostat 14, which may be a Honeywell Model T87F Thermostat of a type containing a bi-metal temperature sensor that controls the state of a liquid mercury switch, is in a pair of complementary loop circuits 24, 26. Each loop circuit 24, 26 contains a current detector 28, 30, preferably conventional ferrods such as is described in U.S. Pat. No. 3,671,759, incorporated herein by reference. Lines 36, 46 of loop 24 and lines 36, 50 of loop 26 are preferably provided by the telephone lines 16 (FIG. 1) interconnecting facility 10 and control center 18. A current source 32 in common line 36 of loop circuits 24, 26 is provided by the telephone company with an operating voltage supplied on telephone lines 16 in a conventional manner. A circuit interrupter 34, to be described hereinafter, is in line 50 of loop circuit 26.

Each ferrod 28, 30 located at the control center 18 is a transformer wound on a ferrite core wherein coupling between its primary $P_1$, $P_2$ and secondary $S_1$, $S_2$ windings is controlled by current in a control winding $C_1$, $C_2$. When no current is applied to the control winding $C_1$, $C_2$, the ferrod 28, 30 is "unsaturated" and coupling between primary winding $P_1$, $P_2$ and secondary $S_1$, $S_2$ winding takes place. However, when sufficient current is applied to the control winding $C_1$, $C_2$ to saturate the ferrite core, there is no coupling between the primary $P_1$, $P_2$ and secondary $S_1$, $S_2$ windings of ferrods 28, 30.

Loop 24 is connected to the control winding $C_1$ of ferrod 28, a pulse generator 29 is connected to primary windings $P_1$ and the output of the ferrod is obtained at secondary winding $S_1$. The ferrod 28 thus transmits pulses derived from pulse generator 29 only if the ferrod is not saturated by current $I_1$ in loop 24.

Similarly, loop 26 is connected to control winding $C_2$ of ferrod 30, a pulse generator 31 is applied to primary winding $P_2$ and the output of the ferrod is obtained at secondary winding $S_2$. Coupling between primary winding $P_2$ and secondary winding $S_2$ of the ferrod 30 is thus controlled by current in loop 26.

One line 36 common to circuit loops 24, 26 is connected, through current source 32, to a common terminal 42 of thermostat 14. One output terminal 44 of the thermostat 14 is connected to line 46 of loop 24; the other output terminal 48 of the thermostat is connected to line 50 of loop 26.

Loop circuit 24 thus consists of current source 32, line 36, thermostat terminals 42, 44, line 46 and ferrod control winding $C_1$; loop 26 consists of current source 32, line 36, thermostat terminals 42, 48, line 50, interrupter 34 and ferrod control winding $C_2$. Switch operator 52 within thermostat 14 thus alternatively closes loop circuit 24 or 26 to establish a current flow path therein.

Assume first that ambient temperature measured by the thermostat 14 is below a predetermined temperature whereby the thermostat switch 52 in the position shown in a solid line in FIG. 2 interconnects output terminal 44 and common terminal 42. Loop circuit 24 is thereby closed, and loop circuit 26 is opened. Current from current source 32 flows only through loop 24 (line 36, thermostat contacts 42, 44, and line 46) and saturates the ferrod 28 at control winding $C_1$.

When ambient temperature is at or above the predetermined temperature, the thermostat switch operator 52 changes state. With the switch operator 52 now in the opposite position, shown in a dotted line in FIG. 2, a current flow path is established only in loop 26, saturating ferrod 30. The switch operator 52 is in one position or the other to saturate ferrod 28 or 30, but not both, depending upon ambient temperature measured at by thermostat 14.

Accordingly, when the ambient temperature measured by thermostat 14 is below a predetermined temperature, pulses from pulse generator 31 are coupled by unsaturated ferrod 30 to computer 20, whereas pulses developed by generator 29 are not coupled through saturated ferrod 28. When the temperature measured by thermostat 19 is at or above the predetermined temperature, on the other hand, pulses from generator 29 are coupled to computer 20 through unsaturated ferrod 28 whereas pulses from generator 31 are not coupled to the computer through saturated ferrod 30.

Computer 20 is programmed to monitor the outputs of ferrods 28, 30 through appropriate signal conditions (not shown) and, using conventional character generator 20A, apply a suitable alarm message to cathode ray tube monitors 22 if either the ferrod 28 becomes unsaturated or the ferrod 30 becomes saturated.

The computer 20 preferably is programmed to respond to changes in the outputs of ferrods 28 and 30, i.e., to negative transitions of current $I_1$ in loop 24 and to positive transactions of current $I_2$ in loop 26. Each time there is a loop current transition in the proper direction, caused by a change of state of switch 52 in thermostat 14, the computer 20 transmits a single display message to monitors 22. For example, when switch 52 is in the position shown in FIG. 2 indicating that the temperature monitored by thermostat 14 is not excessive, saturation current flows in loop 24 and no current flows in loop 26. No message accordingly is applied to monitors 22. In response to excessive temperature measured by thermostat 14, the switch 52 changes state, and current $I_1$ in loop 24 undergoes a negative transition (to zero) whereas current $I_2$ in loop 26 undergoes a positive transition to saturate ferrod 30. In response to either transition, the computer 20 generates an alarm message for display in cathode ray tube monitors 22.

Only a single alarm message is displayed by monitors 22 as a result of a current transition in at least one of the two loops 24, 26 indicating the occurrence of an over-temperature condition at facility 10. To cause computer 20 to generate successive alarm messages when an over temperature condition is sensed by thermostat 14, interrupter 34 in line 50 of loop 26 periodically opens the loop to create current transitions therein. This causes computer 22 to generate successive alarm messages during a prolonged over-temperature condition at facility 10. The interrupter 34, as shall be described in detail below, preferably is a solid state timer that derives its operating current from the loop 26 of telephone lines 16 (FIG. 1), and draws current that is insufficient to significantly load the lines.

Of particular significance, the system of FIG. 2 is highly reliable as a result of the complementary loop circuits 24, 26 whereby a failure in either loop will not disable the alarm. This is because a current transition in either loop circuit 24, 26 that occurs as a result of the change of state of switch 52 in thermostat 14 is sufficient to cause computer 20 to generate an alarm message. Operation of the system in this manner can be appreciated with reference to FIGS. 4(*a*)–4(*c*).

Assume initially that switch 52 of thermostat 14 is in the position shown in the solid line in FIG. 2, i.e., no over-temperature condition at the facility 10 is measured. Ferrod 28 is saturated by current $I_1$ in loop 24 as shown by waveform (1) in FIG. 4(*a*), and concurrently ferrod 30 is unsaturated as shown by FIG. 4(*b*). Since no current transition takes place prior to time $T_1$ in FIGS. 4(*a*)–4(*c*), computer 20 does not receive any alarm signal from the ferrods at 15.

Assume now that an over-temperature condition in facility 10 takes place at time $T_1$. Switch 52 of thermostat 14 changes state (see dotted line in FIG. 2) and loop current $I_1$ undergoes a negative transition to zero, unsaturating ferrod 28. Current $I_2$ in loop 26 concurrently makes a positive transition as shown by waveform (4) in FIG. 4(*b*) to saturate ferrod 30. Computer 20 in response to the negative transition of $I_1$ and the positive transition $I_2$ at $T_1$ generates an alarm message (4) in FIG. 4(*c*). It is to be noted, however, that either one of the two current transitions would have been sufficient to cause the computer 20 to generate the alarm message because the computer is programmed to respond to either saturation of ferrod 30 or unsaturation of ferrod 28.

Assume further that at time $T_2$, and ambient temperature drops below the predetermined temperature whereby switch 52 of thermostat 14 returns to the position shown in the solid line of FIG. 2. Current $I_1$ undergoes a positive transition and concurrently current $I_2$ undergoes a negative transition, shown respectively waveform (2) in FIG. 4(*a*) and waveform (4) in FIG. 4(*b*). Because there is no negative transition of current $I_1$ or any positive transition of current $I_2$, no alarm signal is generated at time $T_2$, as shown in FIG. 4(*c*).

Assume next that at time $T_3$, ambient temperature again exceeds the predetermined temperature. Current $I_1$ undergoes another negative transition, as shown by waveform (2) to unsaturate ferrod 28 whereas current $I_2$ undergoes a positive transition shown by waveform (5) to saturate ferrod 30. In response, computer 20 generates an alarm signal (10) in FIG. 4(*c*).

Following $T_3$, the over-temperature condition is assumed to remain extant for an extended period of time, e.g., greater than the duration of waveform (4). Interrupter 34 periodically opens as shown in FIG. 4(*b*) at waveforms (5), (6) and (7) to develop additional positive current transitions at times $T_4$ and $T_5$ while additional alarm signals (11) and (12) are concurrently generated, as shown in FIG. 4(*c*). It is pointed out that during this interval of time $T_3$ to $T_5$, there is no current transition in loop 24; the positive transitions of current in loop 26 are themselves sufficient to generate alarm signals (11) and (12).

At time $T_6$, the ambient temperature drops below the predetermined temperature, in this example, and switch 52 returns to the position shown in FIG. 2. Current $I_1$ in loop 24 undergoes a positive transition, as shown by waveform (3) to saturate ferrod 28 and concurrently current $I_2$ in loop 26 undergoes a negative transition at waveform (7) to unsaturate ferrod 30. No alarm signal is generated at time $T_6$ since there is no negative transition of current $I_1$ and no positive transition of current $I_2$.

At time $T_7$, with ambient temperature at facility 10 again exceeding the predetermined temperature, the switch 52 changes state (dotted line in FIG. 2), and current $I_1$ in loop 24 undergoes a negative transition, as shown by waveform (3). Due to a fault in ferrod 30 or elsewhere in loop 26, however, no positive transition in loop 26 is detected [FIG. 4(*b*)]. However, because a negative transition of loop current $I_1$ has been detected, alarm signal (13) at $T_7$ is generated.

Conversely, if an over temperature condition causes current $I_2$ in loop 26 to undergo a positive transition, shown by waveform (8) whereas due to a fault in loop 24 no corresponding negative transition of loop current $I_1$ is detected, computer 20 generates alarm signal 14. The circuit shown in FIG. 2 thus is fail-safe.

As another level of reliability in the invention, because an alarm signal is generated in response to any negative transition of loop current $I_1$, if there is a failure of switch 14 or ferrod 28 causing saturation current to terminate, an alarm signal will be generated by computer 20. Similarly, only short circuiting of interrupter 34 in loop 26 during an over-temperature condition while the loop is otherwise closed by switch 52 will cause an alarm signal to be generated.

As mentioned previously, the interrupter 34 is a solid state circuit that obtains its operating power directly from the telephone lines at line 50, and does not significantly load the telephone lines as the interrupter switches between its open and closed states.

In accordance with the preferred embodiment, the interrupter 34, having the configuration and component values shown in detail in FIG. 3, draws a maximum of 0.1 milliamp at quiescence and at least a maximum of 8 milliamp in an on state, and switches every 15 minutes at a fifty percent duty cycle. The circuit 34 shown in FIG. 3 is connected in series with line 50 at terminals a and b. Resistors R1 and R2 are current limiters to prevent excessively loading the telephone lines if there is a short circuit elsewhere in the interrupter 34. The input resistors R1 and R2 are connected to the input terminals of full wave diode bridge CR1 which together with Zener diode CR2 supplies an operating voltage of the proper plurality to the remainder of the circuit independent of the plurality of the input voltage. Resistors R1, R2 and R5 form a voltage divider network to apply proper supply voltage to a timer U1, which preferably is a conventional CMOS type 555 integrated circuit timer.

Resistors R3 and R4, together with capacitor C1, control integrated circuit timer U1 to operate in an astable mode with a 15 minute, 50 percent duty cycle. Capacitor C2 decouples the timer to cause the timer to be generally insensitive to high frequency noise. The timer U1 controls transistor Q1 between on and off output states to periodically interrupt line 50.

There has accordingly been described a fail-safe alarm system that uses complementary loop circuits and ferrods to develop alarm signals in response to excessive ambient temperatures, wherein a failure in either loop is insufficient to disable the system. A monitor displays an alarm message in response to an over-temperature condition. A circuit interrupter opens one of the loops periodically to generate successive alarm messages until corrective action is taken.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

What is claimed is:

1. A fail-safe alarm system, comprising:

an external parameter sensing means;

first and second current detectors each developing an output signal in response to an input current;

a first circuit containing a source of direct current and said first current detector;

a second circuit containing the direct current source and said second current detector;

switch means responsive to said parameter sensing means for closing alternatively said first and second circuits to cause direct current to flow alternatively therein; and alarm means responsive to outputs of said first and second current detectors for generating an alarm signal in response to a change in direct current flowing in at least one of said first and second circuits.

2. The system of claim 1, wherein said first and second current detectors each comprise a saturable transformer having a primary winding, a secondary winding and a control winding for controlling coupling between said primary winding and said secondary winding, said control winding connected to one of said first and second circuits, and said primary and secondary windings connected respectively to a signal source and said alarm means.

3. The system of claim 1, wherein said second circuit is closed by said switch means in response to a predetermined parameter sensed by said sensing means, including interrupter means for periodically interrupting said second circuit whereby said alarm means repetitively generates alarm signals.

4. The system of claim 1, wherein said external parameter sensing means comprises a temperature detector.

5. The system of claim 1 wherein said external temperature means and said switch means comprise a temperature thermostat.

6. The system of claim 1, wherein said current detectors comprise ferrods.

7. The system of claim 1, wherein said alarm means includes a cathode ray tube and character generator means for displaying an alarm message on said cathode ray tube.

8. The system of claim 1, including means responsive to said first and second current detectors for generating output signals in response to saturation currents in said first and second circuits, said alarm means including means for generating a first alarm message when said first current detector becomes unsaturated and means for generating a second alarm message when said second current detector becomes saturated.

9. The system of claim 8, including interrupter means for periodically interrupting said second circuit when said second current detector is saturated to cause said alarm means to generate said second alarm message periodically.

10. The system of claim 9, wherein said first and second circuits comprise telephone lines and further wherein said interrupter means is powered from said telephone lines.

11. A fail-safe, temperature responsive alarm system for indicating at least at one remote location an occurrence of an over-temperature condition within a region being monitored, comprising:

a thermostat located within said region being monitored;

first and second current detectors for sensing direct current applied thereto;

a first circuit loop containing, in series, a source of direct current, said first current detector and said thermostat;

a second circuit loop containing, in series, the direct current source, said second current detector and said thermostat;

said thermostat including switch means operative in a first position maintaining said first circuit loop closed and said second circuit loop open when a temperature of said region is below a predetermined temperature, and operative in a second position maintaining said first circuit loop open and said second circuit loop closed when said temperature of said region is at or above said predetermined temperature; and output means responsive to said first and second current detectors for generating an alarm signal in the presence of direct current in said first circuit loop or in the absence of direct current in said second circuit loop.

12. The system of claim 11, wherein said first and second current detectors comprise ferrods.

13. The system of claim 11, wherein said output means includes means for generating said alarm signal in response to a positive current transition in said second circuit loop or in response to a negative current transition in said first circuit loop, and further including an interrupter means for periodically interrupting said second circuit loop whereby said output means generates alarm signals repetitively.

14. The system of claim 13, wherein said second circuit loop comprises telephone lines, and said interrupter means is powered by current on said telephone line current.

15. The system of claim 11, including display means responsive to said alarm signal for displaying an alarm message.

16. A failsafe method of detecting an over-temperature ambient condition in a region being monitored, comprising the steps of:

measuring ambient temperature in the region being monitored;

when the ambient temperature is less than a predetermined temperature generating a direct current in only one of first and second circuits;

when the ambient temperature is equal to or greater than said predetermined temperature generating a direct current in only the other one of said first and second circuits;

measuring direct current in said first and second circuits; and generating an alarm signal when an absence of direct current in said first circuit or a presence of direct current in said second circuit is detected.

17. The system of claim 16, wherein said generating step includes generating the alarm signal when there is a positive current transition in said second circuit or a negative current transistion in said first circuit.

18. The system of claim 17, including the additional step of periodically interrupting said second circuit to generate successive alarm signals.

* * * * *